United States Patent [19]

Kabasin

[11] Patent Number: 4,664,090

[45] Date of Patent: May 12, 1987

[54] AIR FLOW MEASURING SYSTEM FOR INTERNAL COMBUSTION ENGINES

[75] Inventor: Daniel F. Kabasin, Rochester, N.Y.

[73] Assignee: General Motors Corporation, Detroit, Mich.

[21] Appl. No.: 786,608

[22] Filed: Oct. 11, 1985

[51] Int. Cl.[4] ..... F02M 51/00

[52] U.S. Cl. ..... 123/494; 123/568; 123/478; 73/118.2; 73/195; 364/431.05; 364/510

[58] Field of Search ..... 123/478, 480, 486, 494, 123/568, 569, 571; 73/118 A, 195, 198, 861.02, 861.03, 861.21, 861.52, 861.61; 364/431.05, 510

[56] References Cited

U.S. PATENT DOCUMENTS

| | | | |
|---|---|---|---|
| 3,871,214 | 3/1975 | Masaki et al. | 73/116 |
| 4,142,407 | 3/1979 | Kurolwa et al. | 73/118 A |
| 4,155,332 | 5/1979 | Yaegashi et al. | 123/480 |
| 4,290,404 | 9/1981 | Hata et al. | 123/571 |
| 4,332,226 | 6/1982 | Nomura et al. | 123/494 |
| 4,398,525 | 8/1983 | Ahrns et al. | 123/568 |
| 4,399,791 | 8/1983 | Kobayashi et al. | 123/571 |
| 4,446,523 | 5/1984 | Reinke | 364/431.05 |
| 4,599,694 | 7/1986 | Aposchanski et al. | 364/431.05 |

*Primary Examiner*—Willis R. Wolfe, Jr.
*Attorney, Agent, or Firm*—Howard N. Conkey

[57] ABSTRACT

A system for measuring the air flow into the engine over the full operating range thereof is described employing a pair of air flow measuring concepts selectively enabled dependent upon engine operation so as to accurately achieve a measurement of air flow over the full range of engine operation.

2 Claims, 3 Drawing Figures

AIR FLOW MEASURING SYSTEM FOR INTERNAL COMBUSTION ENGINES

This invention relates to an air flow measuring system for an internal combustion engine.

Numerous systems have been proposed for measuring the mass rate of air flow into an internal combustion engine. One category of these systems requires an air flow sensing element such as a constant temperature anemometer positioned in the air stream to sense air flow. Another category of these systems determines engine air flow from measured values of various engine operating parameters such as manifold absolute pressure, engine speed and throttle angle.

The latter category includes the known speed-density and throttle angle-pressure methods of air flow measurement. The speed-density method measures air flow based on the pressure in the intake manifold of the engine and the engine speed. The throttle angle-pressure method of measuring air flow is based upon the angle of the throttle in the throttle bore which defines a variable orifice, and the ratio of the absolute pressure in the intake manifold of the engine to atmospheric pressure.

Air flow measurement based on the throttle angle-pressure method has an advantage in that it provides for a measurement of air flow that is undisturbed by exhaust gases recirculated to the engine intake manifold as generally employed by automotive vehicles. However, when the ratio of the manifold absolute pressure to the atmospheric pressure exceeds a value around 0.9, this form of measurement becomes less accurate. The manifold pressure value varies over a narrow range over the full range of engine speeds when the throttle is substantially wide open and manifold absolute pressure sensors generally do not have the appropriate dynamic range or resolution to discern pressure drops at this substantially wide-open throttle operation. Further, when an idle air control system is employed for controlling the idle speed of the engine by variably controlling air bypassed around the throttle, air flow measurement by use of the throttle angle-pressure method must take into account the idle air bypassed resulting in greater system, software and calibration complexity.

On the other hand, air measurement by use of the speed density method is unaffected by air bypassed around the throttle during idle speed control nor is its accuracy affected at high ratios of manifold absolute pressure to barometric pressure. However, this method is affected by exhaust gases recirculated into the intake manifold.

The subject invention provides for an improved system for measuring the air flow into an internal combustion engine that utilizes the advantages of each of the speed-density and throttle angle-pressure methods by selectively employing each of the methods in the above-described engine operating regions at which it is best suited for air measurement. This provides for simpler and more accurate measurement of mass air flow via the throttle angle-pressure method while EGR is enabled and provides for measurement of mass air flow by the speed-density method near wide-open throttle and at idle conditions where exhaust gases are not recirculated to the intake manifold.

The invention may be best understood by reference to the following description of a preferred embodiment and the drawings in which.

Figure 1:
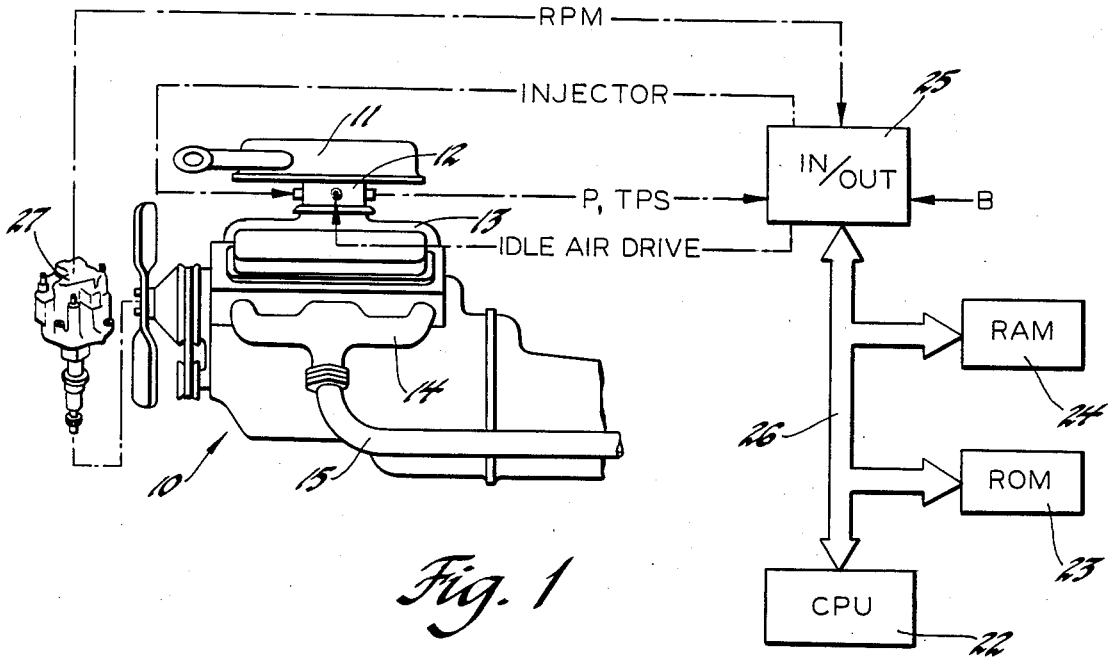
FIG. 1 shows a schematic and block diagram of an engine employing the air flow measurement system of the present invention.
Figure 2:
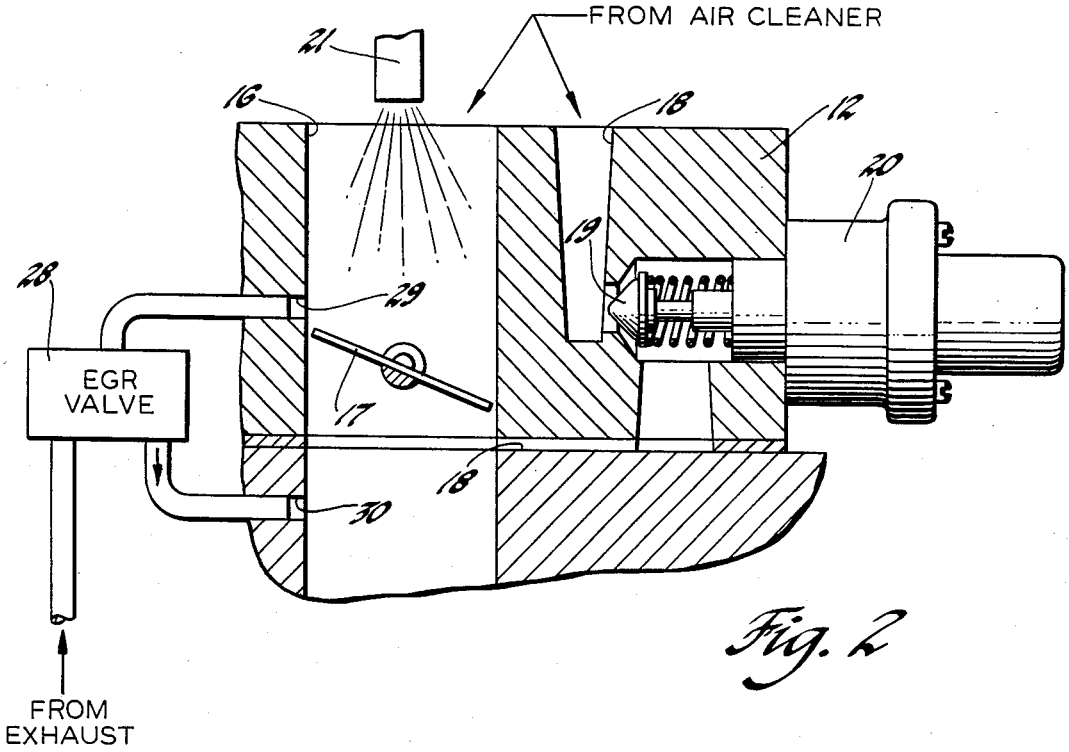
FIG. 2 shows a cutaway of a portion of the air and fuel supply system of the engine of FIG. 1.

Referring to FIG. 1, an internal combustion engine 10 has an air intake apparatus including an air cleaner 11, a throttle body 12, an intake manifold 13 and an exhaust apparatus including an exhaust manifold 14 and an exhaust pipe 15. As seen in FIG. 2, the throttle body 12 defines a main air induction passage 16 having therein an operator-controlled throttle valve 17 and an idle air bypass passage 18 which bypasses the throttle 17. The passage 18 includes an idle air control valve 19 positioned by a solenoid 20 to control the amount of air bypassed around the throttle for idle speed control. Fuel injection apparatus is generally denoted by an injector 21 positioned to inject a controlled quantity of liquid fuel into the main air induction passage 16. The amount of fuel injected is based on the total measured air flow into the internal combustion engine 10 through the induction and bypass passages 16 and 18 and a desired air/fuel ratio.

Referring again to FIG. 1, the system includes a digital computer apparatus having a central processing unit (CPU) 22, a read-only memory (ROM) 23, a random access memory (RAM) 24, and an input/output device (I/O) 25. These devices are standard and are interconnected in the normal manner with buses and other lines indicated generally by a bus 26. Inputs to the I/O 25 include an engine speed signal (rpm), provided by an engine driven distributor 27 which generates a pulse signal having a frequency varying with engine speed, a manifold absolute pressure signal (P) and a throttle position sensor signal (TPS), provided from a manifold absolute pressure sensor and a throttle position sensor, respectively, not shown, but included within the throttle body 12, and an atmospheric pressure signal (B) from a pressure sensor monitoring the atmospheric pressure. A duty cycle modulated idle air drive signal is provided to the solenoid 20 to position the valve 19 in accord with sensed engine speed to control the air bypassed around the throttle 17 to maintain a predetermined engine idle speed when the throttle valve 17 is closed. Timed injector drive signals are provided to the injector 21 having durations calculated to provide a predetermined desired air/fuel ratio.

As seen in FIG. 2, the engine includes an exhaust gas recirculation (EGR) system comprising a conventional backpressure EGR valve 28 having a pneumatic vacuum signal input through an opening 29 in the throttle body 12 that is traversed by the throttle blade 17 when moved from idle to off-idle position. The EGR valve 28 is pneumatically coupled to the exhaust manifold 14 to recirculate exhaust gases to the intake manifold 13 via an opening 30 in the throttle body 12 when a vacuum signal is provided through the opening 29 while the throttle is off idle to expose the opening 29 to manifold vacuum. The vacuum signal through the opening 29 is reduced to zero to disable exhaust gas recirculation when the throttle 17 is closed or when it approaches a wide open position resulting in the manifold absolute pressure P becoming substantially equal to atmospheric pressure B.

To accurately meter fuel into the engine 10, the subject invention employs the two air metering concepts previously described. As indicated, the speed density concept measures the air flow into the engine 10 based on the manifold absolute pressure in the intake manifold 13 downstream of the throttle 17 and the engine speed. Also, as described, this method of measuring air flow is affected by the exhaust gases recirculated by the EGR valve 28 since the manifold absolute pressure is dependent in part on the exhaust gases recirculated. However, air flow measured by the speed density method measures both the air through the passage 16 and the bypass passage 18 so that it is unaffected by the air bypassed around the throttle 17 through the passage 18 and valve 19 during engine idle.

From this, it can be seen that speed-density for measuring air flow into the engine is most beneficial during periods when there are no exhaust gases being recirculated to the intake manifold 13. These periods exist when the throttle 17 is closed and when the throttle 17 is substantially wide open.

Also, as previously described, the throttle angle-pressure concept for measuring air flow employs the angle of the throttle 17 defining a variable orifice in the induction passage 16 and the ratio P/B of the manifold absolute pressure P in the intake manifold 13 downstream of the throttle 17 and atmospheric pressure B. This method of measuring air flow is unaffected by the exhaust gases recirculated to the intake manifold but is affected by the air bypassed around the throttle during idle speed control operation of the engine 10 since the variable orifice established by the idle speed control valve 19 is unaccounted for. Further, the use of the throttle angle-pressure method of measuring air flow becomes less accurate when the throttle 17 is substantially wide open as represented by a critical P/B pressure ratio above a predetermined value such as due to the limited dynamic range of the MAP sensor. From this it can be seen that this method of measuring air flow is most beneficial and provides the most accurate measure of air flow during off-idle periods of the throttle 17 during which the idle air bypass control valve 19 can be positioned fully closed or open to provide a known orifice area and when the throttle position is greater than the position resulting in the critical P/B ratio. This throttle angle-pressure method for measuring air flow is described in greater detail in U.S. Pat. No. 4,446,523 which is assigned to the assignee of this invention.

By selectively utilizing the above two methods of measuring air flow into the engine, an accurate measurement of air flow into the engine over the full range of engine operation may be provided which enables superior control of the air/fuel ratio of the mixture supplied to the engine 10.

Figure 3:
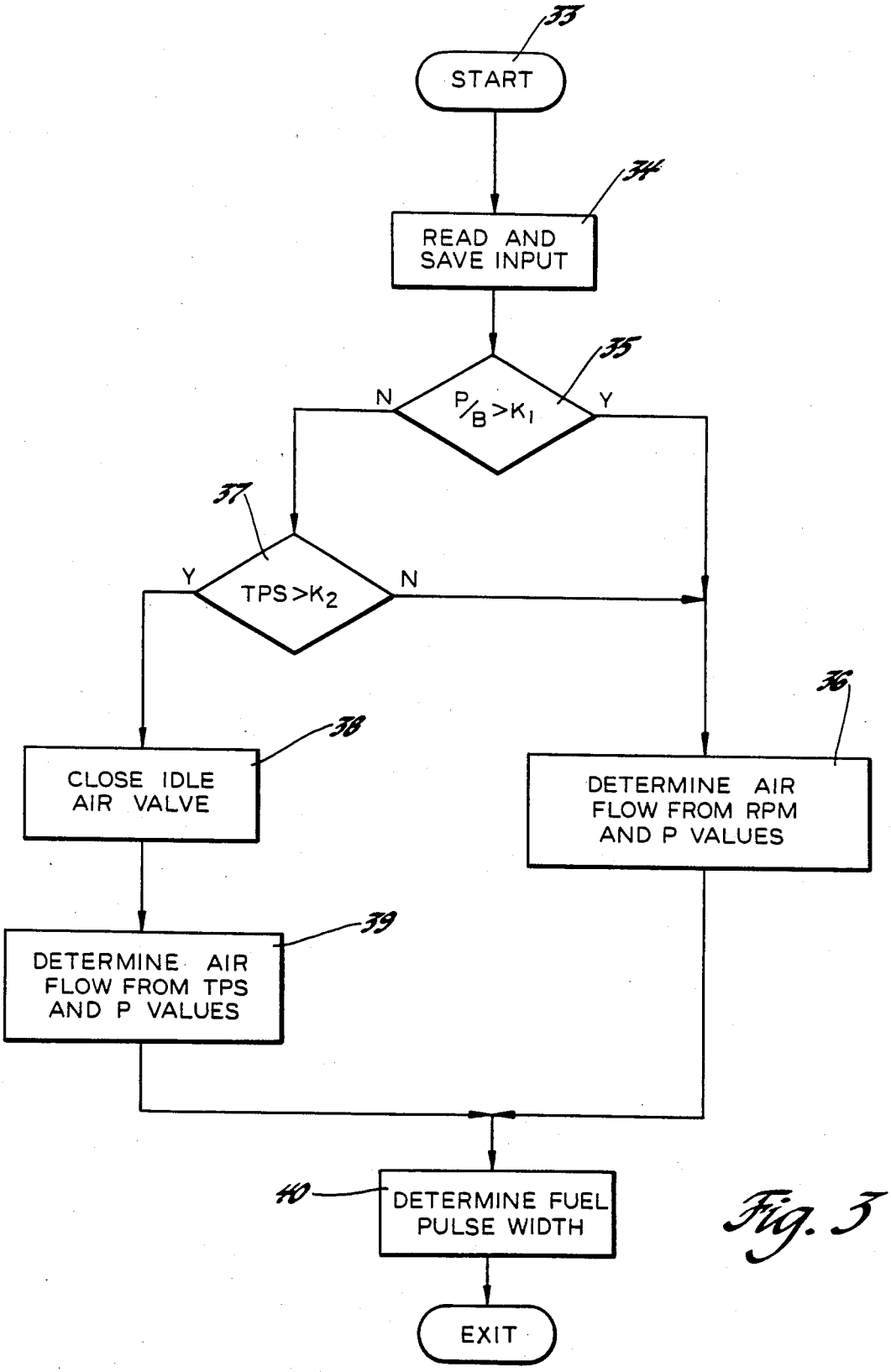
FIG. 3 shows a computer flow chart describing the operation of the system in accord with the principles of this invention.

Referring to FIG. 3, a flow chart illustrating the operation of the digital computer system of FIG. 1 for measuring the air flow into the engine in accord with the principles of this invention is illustrated. This flow chart of a computer program loop executed by the CPU is repeated periodically at predetermined intervals such as 12.5 milliseconds to provide a continuous determination of air flow into the engine.

The computer program enters the routine to determine air flow at point 33 and proceeds to point 34 where the various inputs to the I/O 25 are read and stored into ROM designated memory locations in the RAM 24. Thereafter the program proceeds to a decision point 35 where the ratio P/B of the values of the manifold absolute pressure P and the barometric pressure B is compared to a predetermined constant $K_1$ which may be, for example, 0.85.

If the ratio exceeds the value $K_1$, the program proceeds to a step 36 where the engine air flow is determined by the speed-density method from the measured values of engine speed and manifold absolute pressure. If, however, the pressure ratio determined at decision point 35 is less than the constant $K_1$,the program proceeds to a decision point 37 where the value of the throttle position is compared with a calibration constant $K_2$. $K_2$ represents the value of the angle of the throttle 17 when at idle position exposing the opening 29 to atmospheric pressure and whereat engine idle speed is controlled by variably adjusting the position of the valve 19.

If the throttle angle is less than the calibration constant $K_2$, the program proceeds to the step 36 where the engine air flow is determined by the speed-density method. However, if at decision point 37 it is determined that the throttle angle is greater than $K_2$ thereby exposing the opening 29 to manifold pressure to enable exhaust gas recirculation, the program proceeds to a step 38 where the duty cycle signal provided to the solenoid 20 to control idle speed is set to zero thereby allowing the valve 19 to close to eliminate bypass air around the throttle 17. Thereafter, the program proceeds to a step 39 where the air flow into the engine is determined based on the throttle angle-pressure method. From step 39 or step 36, the program proceeds to a step 40 where the duration of the injection pulses provided to the injector 21 is determined based on the determined engine air flow into the engine so as to achieve a predetermined desired air/fuel ratio. From step 40, the program exits the routine of FIG. 3.

It is understood, that additional known routines are executed by the digital computer system of FIG. 1 including routines for controlling idle speed when the throttle valve 17 is closed and for issuing the pulse to the injector 20 at appropriate timed intervals.

The foregoing system provides for an accurate measurement of the air flow into the internal combustion engine 10 over the full operation range thereof by combining two air flow measuring concepts and selectively utilizing those concepts in the engine operating regimes at which they are best suited. This provides for a more accurate metering of fuel into the engine so as to substantially achieve the desired air/fuel ratio over the full operating range of the engine.

The foregoing description of a preferred embodiment of the invention for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A system for measuring air flow into an internal combustion engine having an intake manifold and including a throttle bore and a variable position throttle in the throttle bore for varying the area of the induction passage to regulate the mass rate of air flow from the atmosphere into the engine, the system comprising, in combination:

means effective to measure throttle position;

means effective to measure intake manifold pressure P;

means effective to measure engine speed;

means effective to measure atmospheric pressure B;

first air measuring means operative when the throttle position is less than a value $K_2$ representing an engine idle condition or when the ratio P/B is greater than a value $K_1$ representing the pressure in the intake manifold being substantially equal to atmospheric pressure for determining the air flow into the engine from the values of engine speed and intake manifold pressure; and second air measuring means operative when the throttle position is greater than the value $K_2$ and the ratio P/B is less than the value $K_1$ for determining the air flow into the engine from the values of throttle position and intake manifold pressure, whereby the first and second air measuring means provide an accurate measure of engine air flow over the entire operating range of the engine.

2. In an internal combustion engine having an intake manifold and including a throttle bore and a variable position throttle in the throttle bore for varying the area of the induction passage to regulate the mass rate of air flow into the engine, the system comprising:

EGR means for recirculating exhaust gases into the intake manifold when the throttle position is greater than an idle position and when the value of the pressure in the intake manifold attains a predetermined relationship to the value of atmospheric pressure;

idle speed control means for controlling engine idle speed when the throttle position is at the idle position by variably shunting air around the throttle;

first air measuring means for determining the air flow into the engine from the values of the throttle position and the pressure in the intake manifold during the period the values of throttle position and the pressure in the intake manifold represent that the EGR means is recirculating exhaust gases into the intake manifold, the first air measuring means being unaffected by the exhaust gases recirculated into the intake manifold; and second air measuring means for determining the air flow into the engine from the values of the engine speed and the pressure in the intake manifold during the period the values of throttle position and the absolute pressure in the intake manifold represent that the EGR means is not recirculating exhaust gases into the intake manifold, the second air measuring means being unaffected by the air shunted around the throttle by the idle speed control means and by the relationship of the pressure in the intake manifold and atmospheric pressure, the first and second air measuring means being effective to provide an accurate measure of engine air flow over the entire operating range of the engine.

* * * * *